US006997611B2

(12) United States Patent
Chen et al.

(10) Patent No.: US 6,997,611 B2
(45) Date of Patent: Feb. 14, 2006

(54) POSITIONING DEVICE FOR A MULTI-SECTION SLIDE TRACK ASSEMBLY OF DRAWERS

(75) Inventors: Ken-Ching Chen, Kaohsiung Hsien (TW); Shih-Long Hwang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 138 days.

(21) Appl. No.: 10/778,218

(22) Filed: Feb. 17, 2004

(65) Prior Publication Data

US 2005/0180667 A1 Aug. 18, 2005

(51) Int. Cl.
*A47B 88/00* (2006.01)

(52) U.S. Cl. ..... 384/21; 312/333; 312/334.46

(58) Field of Classification Search ..... 312/333, 312/334.44–334.46, 334.8, 334.11, 334.17; 384/21, 18

See application file for complete search history.

(56) References Cited

U.S. PATENT DOCUMENTS

| | | | | |
|---|---|---|---|---|
| 4,252,382 | A * | 2/1981 | Thomas | 384/18 |
| 6,450,600 | B1 * | 9/2002 | Chen et al. | 312/334.46 |
| 6,585,335 | B1 | 7/2003 | Hwang et al. | |
| 6,655,763 | B1 * | 12/2003 | Judge et al. | 312/334.46 |
| 6,715,851 | B1 * | 4/2004 | Yang | 312/334.46 |

* cited by examiner

*Primary Examiner*—Thomas R. Hannon
(74) *Attorney, Agent, or Firm*—Birch, Stewart, Kolasch & Birch, LLP

(57) ABSTRACT

A positioning device for the multi-section slide track assembly includes an inner slide track, an intermediate slide track, and an outer slide track. The positioning device consists of a positioning member and an actuating member pivot-connected thereto. The positioning member provides with at least one engaging end while the actuating member providing with at least one bent guiding edge and a push button. The engaging end is adapted to engage with an oblique protrusion of the outer slide track for positioning the intermediate slide track. A return movement of the inner slide track can actuate the bent guiding edge for automatically unlocking the engagement of the intermediate slide track with the outer slide track. Alternatively, a user can manually press the push button to unlock the engagement of the intermediate slide track with the outer slide track.

11 Claims, 9 Drawing Sheets

POSITIONING DEVICE FOR A MULTI-SECTION SLIDE TRACK ASSEMBLY OF DRAWERS

BACKGROUND OF THE INVENTION

1. Field of the Invention

The present invention relates to a positioning device for a multi-section slide track assembly of drawers. More particularly, the present invention relates to the positioning device for an intermediate slide track that can unlock an engagement of an outer slide track by manually operating a push button or actuating a return movement of an inner slide track.

2. Description of the Related Art

Referring initially to FIG. 12, applicant's own U.S. Pat. No. 6,585,335 discloses a three-section slide track for a drawer. The three-section slide track includes an outer slide track (A1), an intermediate slide track (A2) and an inner slide track (A3). The inner slide track (A3) and the intermediate slide track (A2) are nested in the outer slide track (A1) for stowing purpose. The intermediate slide track (A2) is provided with a positioning plate (A24) and a movable plate (A25), wherein the positioning plate (A24) and the movable plate (A25) are stacked each other to constitute a combination unit. The position plate (A24) employs a connecting member (A23) adapted to connect the combination unit of the positioning plate (A24) and the movable plate (A25) to the intermediate slide track (A2). Accordingly, the movable plate (A25) is able to move along a gap extending between the positioning plate (A24) and the intermediate slide track (A2). The position plate (A24) has a desired degree of flexibility and includes at least one positioning leg (A241) and at least one locking hole (A242). Correspondingly, the outer slide track (A1) includes at least one locking hole (A14) adapted to receive the positioning leg (A241) of the position plate (A24). The movable plate (A25) is a V-shaped member provided with at least one lug (A251) at its first end and at least one oblique protruded wing (A252) at its second end. The lug (A251) of the movable plate (A25) inserts into the locking hole (A242) of the position plate (A24) for confining purpose so that a longitudinally-sliding movement of the movable plate (A25) with respect to the position plate (A24) is limited. Meanwhile, the oblique protruded wing (A252) proximate the second end of the movable plate (A25) can be pressed by an end of the inner slide track (A3) while operating. Thus, the lug (A251) proximate the first end of the movable plate (A25) is relatively lifted with respect to a horizontal plane of the intermediate slide track (A2).

In extending operation, after the intermediate slide track (A2) is drawn out a predetermined distance relative to the outer slide track (A1), the positioning leg (A241) of the position plate (A24) is engaged with the locking hole (A14) of the outer slide track (A1). Consequently, the intermediate slide track (A2) is positioned at a predetermined position with respect to the outer slide track (A1).

In retracting operation, when the inner slide track (A3) is retracted a predetermined distance into the intermediate slide track (A2), an end of the inner slide track (A3) presses the oblique protruded wing (A252) of the movable plate (A25). Synchronously, the lug (A251) at the first end of the movable plate (A25) is relatively lifted with respect to a horizontal plane of the intermediate slide track (A2) to detach the positioning leg (A241) from the locking hole (A14) of the outer slide track (A1). Consequently, the disengagement of the intermediate slide track (A2) from the outer slide track (A1) is carried out for retracting purpose.

In assembling process, the movable plate (A25) is easily taken apart and mis-aligned with the position plate (A24) that increases on elements of the entire structure and sophisticates the entire manufacturing process.

Once the intermediate slide track (A2) releases the inner slide track (A3), the intermediate slide track (A2) extends beyond the outer slide track (A1) that may damage the operator by accident. To avoid causing the damage, the intermediate slide track (A2) must be manually stowed into the outer slide track (A1). However, it is inconvenient for manually operating the movable plate (A25) since the movable plate (A25) is sandwiched between the position plate (A24) and the intermediate slide track (A2). Moreover, it is also inconvenient for manually operating the movable plate (A25) due to lack of a push button.

The present invention intends to provide a positioning device for a multi-section slide track assembly of drawers, components of a computer system for example. The positioning device consists of a positioning member and an actuating member pivot-connected thereto. The actuating member allows a manual operation for unlocking an engagement of an intermediate slide track in such a way to mitigate and overcome the above problem.

SUMMARY OF THE INVENTION

The primary objective of this invention is to provide a positioning device for a multi-section slide track assembly of drawers, components of a computer system for example, which consists of a positioning member and an actuating member pivot-connected thereto. The actuating member allows a manual operation for unlocking an engagement of an intermediate slide track with an outer slide track, thereby simplifying the unlocking operation of the multi-section slide track assembly.

The secondary objective of this invention is to provide the positioning device for the multi-section slide track assembly of drawers, which consists of a positioning member and an actuating member pivot-connected thereto. The actuating member allows employing a return movement of an inner slide track for automatically unlocking an engagement of an intermediate slide track with an outer slide track, thereby facilitating the auto-unlocking operation of the multi-section slide track assembly.

The multi-section slide track assembly of drawers in accordance with the present invention includes an inner slide track, an intermediate slide track, an outer slide track and a positioning device mounted on the intermediate slide track. The positioning device consists of a positioning member and an actuating member pivot-connected thereto. The positioning member provides with at least one engaging end while the actuating member providing with at least one bent guiding edge and a push button. The engaging end is adapted to engage with an oblique protrusion of the outer slide track for positioning the intermediate slide track. A return movement of the inner slide track can actuate the bent guiding edge for automatically unlocking an engagement of the intermediate slide track with the outer slide track. Alternatively, a user can manually press the push button to unlock the engagement of the intermediate slide track with the outer slide track.

In design choice, the positioning device further employs a guiding member mounted in the intermediate slide track for guiding an end of the inner slide track.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings wherein.

DETAILED DESCRIPTION OF THE INVENTION

Figure 1:
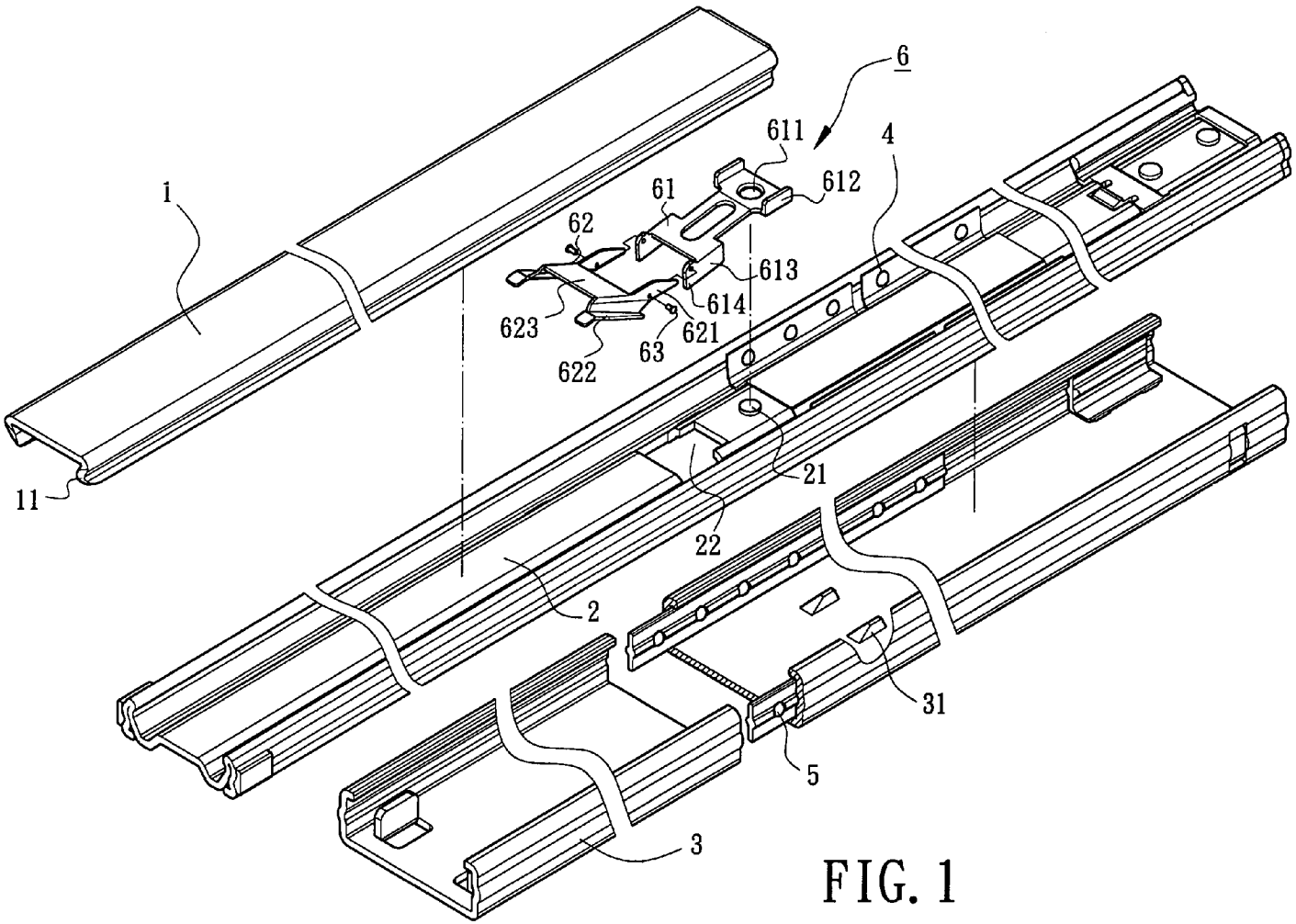
FIG. 1 is an exploded perspective view of a positioning device for a multi-section slide track assembly of drawers in accordance with a first embodiment of the present invention.
Figure 2:
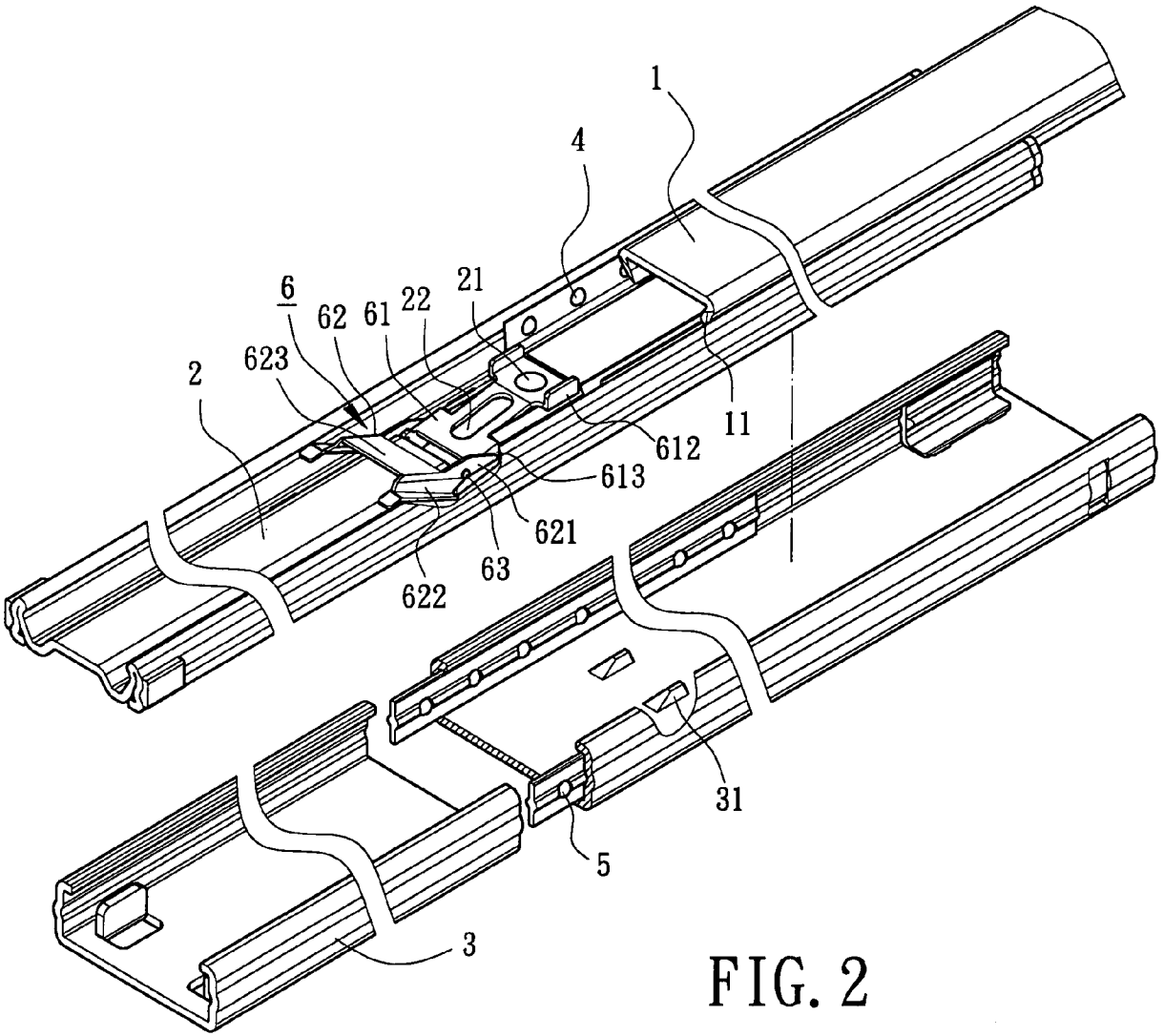
FIG. 2 is an assembled perspective view of the positioning device for the multi-section slide track assembly of the drawers in accordance with the first embodiment of the present invention.

Referring to FIGS. 1 and 2, it depicts that a three-section slide track assembly of drawers includes a positioning device in accordance with the first embodiment of the present invention. The three-section slide track assembly of drawers comprises an inner slide track 1, an intermediate slide track 2 and an outer slide track 3, each of which has a conventional configuration. The inner slide track 1, the intermediate slide track 2 and the outer slide track 3 are rigid and strong to withstand normal use. In retracting (stowing) operation, the inner slide track 1 and the intermediate slide track are nested in the outer slide track 3.

To reduce the running abrasion in use, a pair of ball tracks 4 and 5 are sandwiched in between any two of the inner slide track 1, the intermediate slide track 2 and the outer slide track 3 so as to smoothen slide movement. However, the entire structure is designed to have as low a friction characteristic as possible. In extending operation, the inner slide track 1 is able to extend a predetermined distance in a longitudinal direction with respect to the intermediate slide track 2. Similarly, the intermediate slide track 2 is able to extend a predetermined distance in a longitudinal direction with respect to the outer slide track 3. To avoid a careless release of the inner slide track 1, a conventional retaining member is provided on the inner slide track 1.

Although only the retaining construction of the inner slide track 1 has been discussed, it will be appreciated that the inner slide track 1 includes known structures such as a retaining member, a stop member and the like etc.

Referring again to FIGS. 1 and 2, the intermediate slide track 2 includes a positioning device 6 attached thereto in proper. Construction of the positioning device 6 shall be described in detail below.

The intermediate slide track 2 includes a combination opening 22 for accommodating the positioning device 6. The positioning device 6 consists of a positioning member 61 and an actuating member 62 pivot-connected thereto by pivot members 63. The positioning member 61 is a one-piece member having a desired degree of flexibility and includes an assembling hole 611 and a pair of upright bent stops 612 at its first end. Preferably, the intermediate slide track 2 includes a fixing rod 21 press-fit in the assembling hole 611 of the positioning member 61 that mounts the positioning member 61 on the intermediate slide track 2. In sliding operation, the upright bent stops 612 of the positioning member 61 are used to confine a relatively sliding movement of the ball rack 4 on the intermediate slide track 2. Furthermore, the second end of the positioning member 61 includes a pair of bent teeth 613 and a pair of engaging ends 614 protruded therefrom, and wherein the engaging ends 614 are used to engage with two oblique protrusions 31 of the outer slide track 3.

The actuating member 62 is a one-piece member having a desired degree of rigid. Particularly, the actuating member 62 includes a pair of arms 621 at its first end, and a pair of bent guiding edges 622 and a push button 623 at its second end, wherein the push button 623 connected between the bent guiding edges 622. Each of the bent guiding edges 622 is adapted to support either lateral edge of the inner slide track 1.

Figure 3:
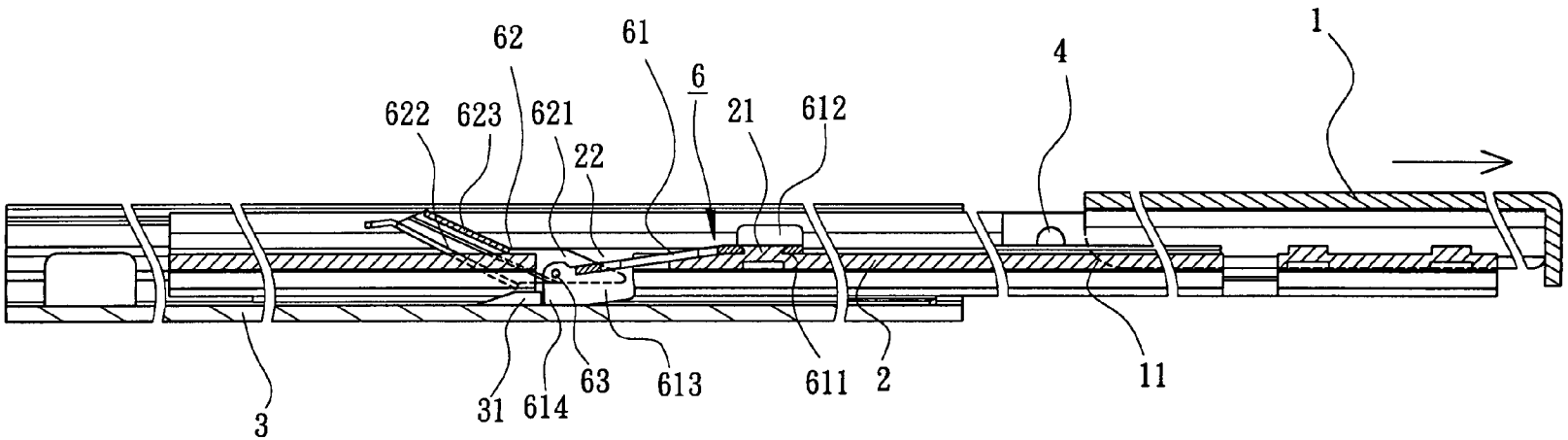
FIG. 3 is a lateral view of the positioning device for the multi-section slide track assembly of the drawers in accordance with the first embodiment of the present invention in extending operation.

Turning now to FIG. 3, it depicts that three-section slide track assembly is extended. Extending operation of the three-section slide track assembly shall be described in detail.

When the inner slide track 1 is drawn out a predetermined distance from the intermediate slide track 2 and the outer slide track 3, the actuating member 62 is disengaged from the inner slide track 1. Thus, the positioning member 61 inclines its second end to the outer slide track 3 so that the engaging ends 614 of the positioning member 61 are engaged with the two oblique protrusions 31 of the outer slide track 3. Consequently, the intermediate slide track 2 is positioned and unable to retract into the outer slide track 3.

Figure 4:
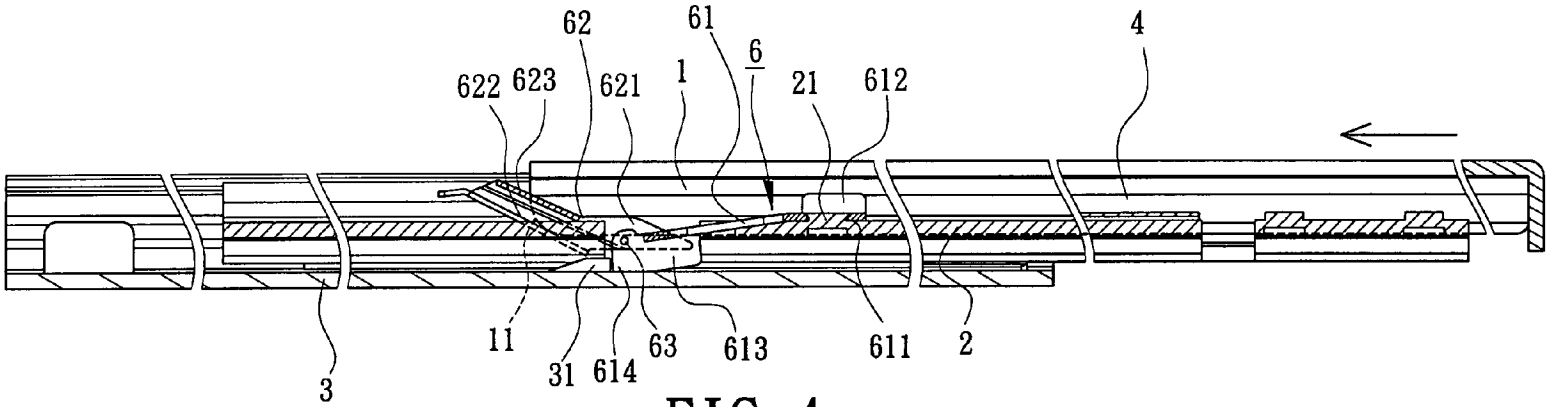
FIG. 4 is a lateral view of the positioning device for the multi-positioning device for the multi-section slide track assembly of the drawers in accordance with the first embodiment of the present invention in a first step of retracting operation.

Turning now to FIG. 4, it depicts that the three-section slide track assembly is retracted in the first step. Retracting operation of the inner slide track 1 shall be described in detail.

When the inner slide track 1 is initially inserted a predetermined distance into the intermediate slide track 2, an end 11 of the inner slide track 1 presses the bent guiding edges 622 of the actuating member 62. Synchronously, the end 11 of the inner slide track 1 may lift the connection of the arms 621 with the bent teeth 613 of the positioning device 6. As a result, the return movement of the inner slide track 3 may disengage the bent teeth 613 of the positioning member 61 from the oblique protrusions 31 of the outer slide track 3. Alternatively, a user can manually press the push button 623 of the actuating member 62 which can disengage the bent teeth 613 of the positioning member 61 from the oblique protrusions 31 of the outer slide track 3.

Figure 5:
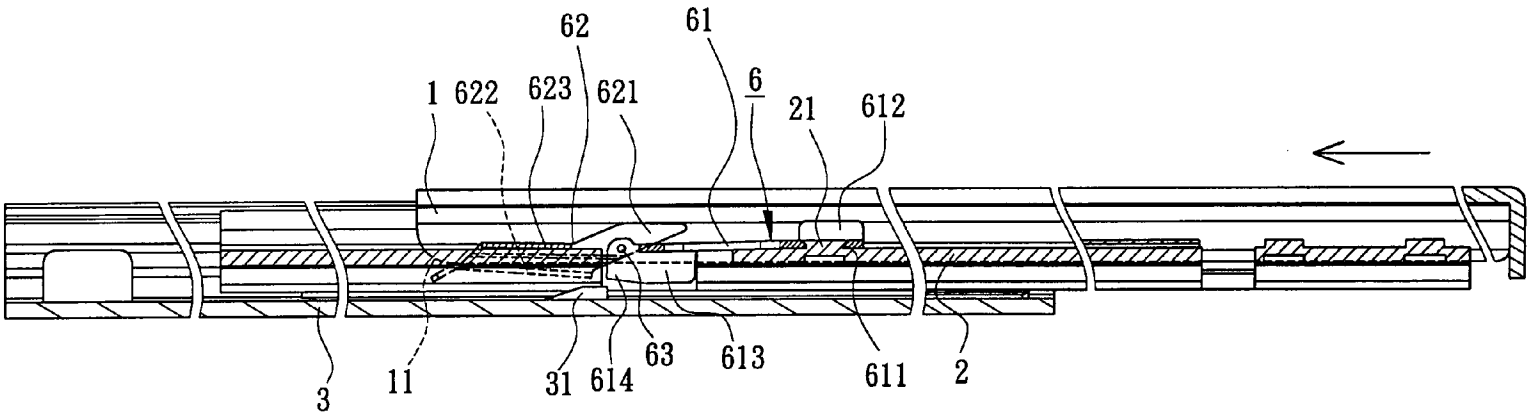
FIG. 5 is a lateral view, similar to that shown in FIG. 4, of the positioning device for the multi-section slide track assembly of the drawers in accordance with the first embodiment of the present invention in a second step of retracting operation.

Turning now to FIG. 5, it depicts that the three-section slide track assembly is retracted in the second step. Retracting operation of the inner slide track 1 and the intermediate slide track 2 shall be described in detail.

When the inner slide track 1 is successively inserted into the intermediate slide track 2, the bent teeth 613 of the positioning member 61 is disengaged from the oblique protrusions 31 of the outer slide track 3. Consequently, the intermediate slide track 2 is unlocked and allowed being pushed into the outer slide track 3.

Figure 6:
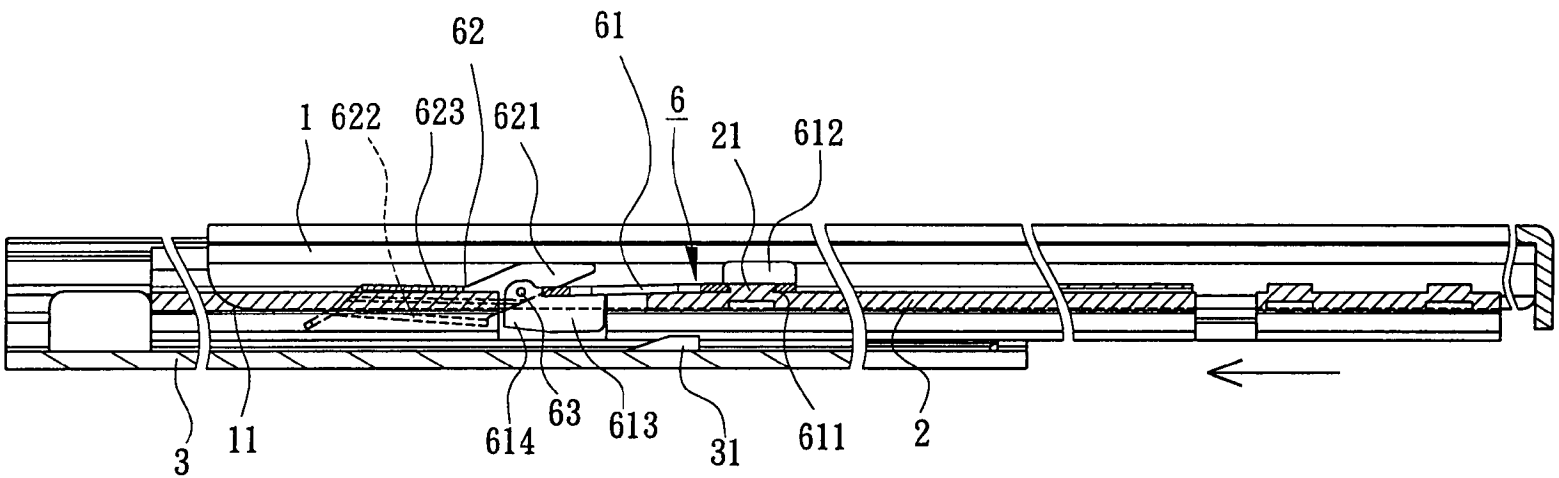
FIG. 6 is a lateral view, similar to that shown in FIG. 4, of the positioning device for the multi-section slide track assembly of the drawers in accordance with the first embodiment of the present invention in a third step of finally retracting operation.

Turning now to FIG. 6, it depicts that the three-section slide track assembly is completely retracted in the third step. Finally retracting operation of the inner slide track 1 and the intermediate slide track 2 shall be described in detail.

Finally, the combination of the inner slide track 1 and the intermediate slide track 2 can be pushed into the outer slide track 3 without any obstruction. Consequently, the inner slide track 1 and the intermediate slide track 2 are nested in the outer slide track 3 and the three-section slide track assembly is completely retracted.

Figure 7:
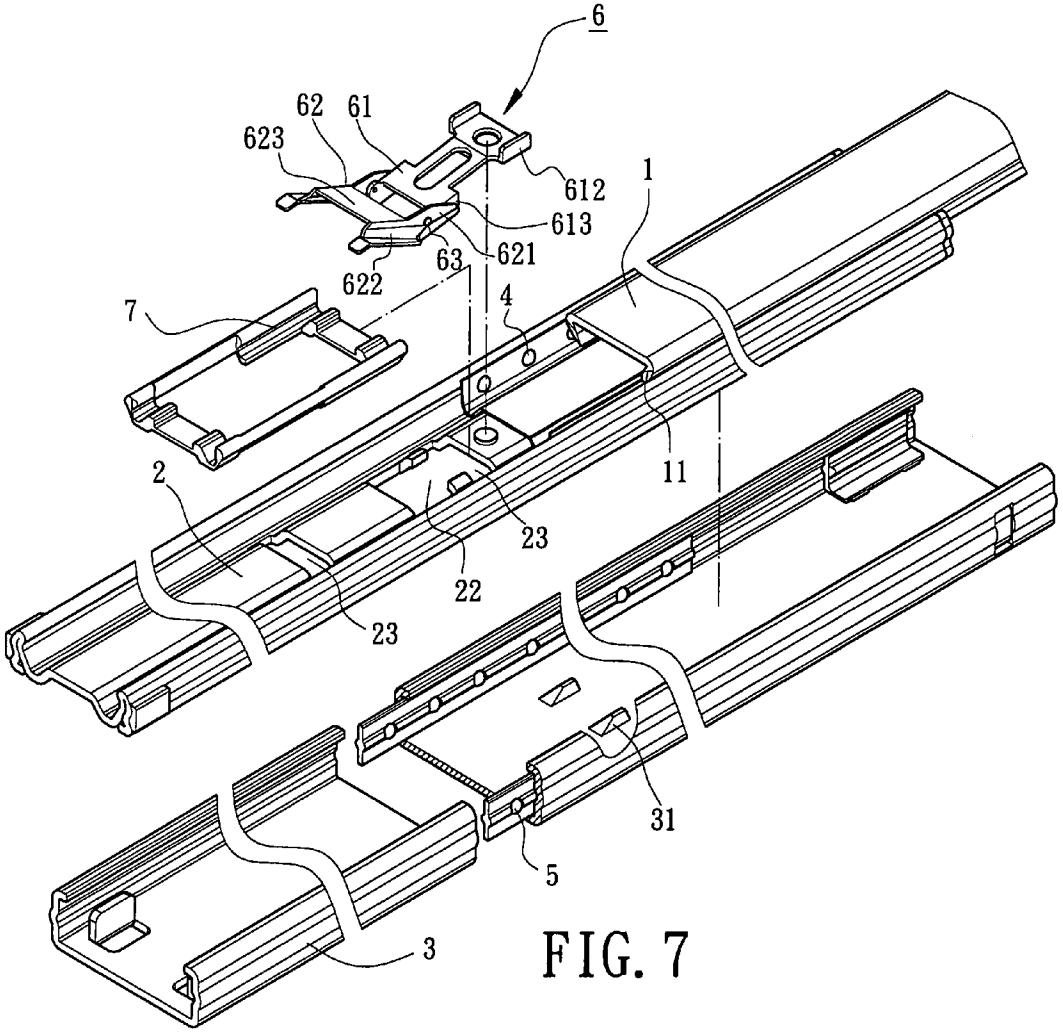
FIG. 7 is an exploded perspective view of a combination of a positioning device with a guiding member for a multi-section slide track assembly of drawers in accordance with a second embodiment of the present invention.
Figure 8:
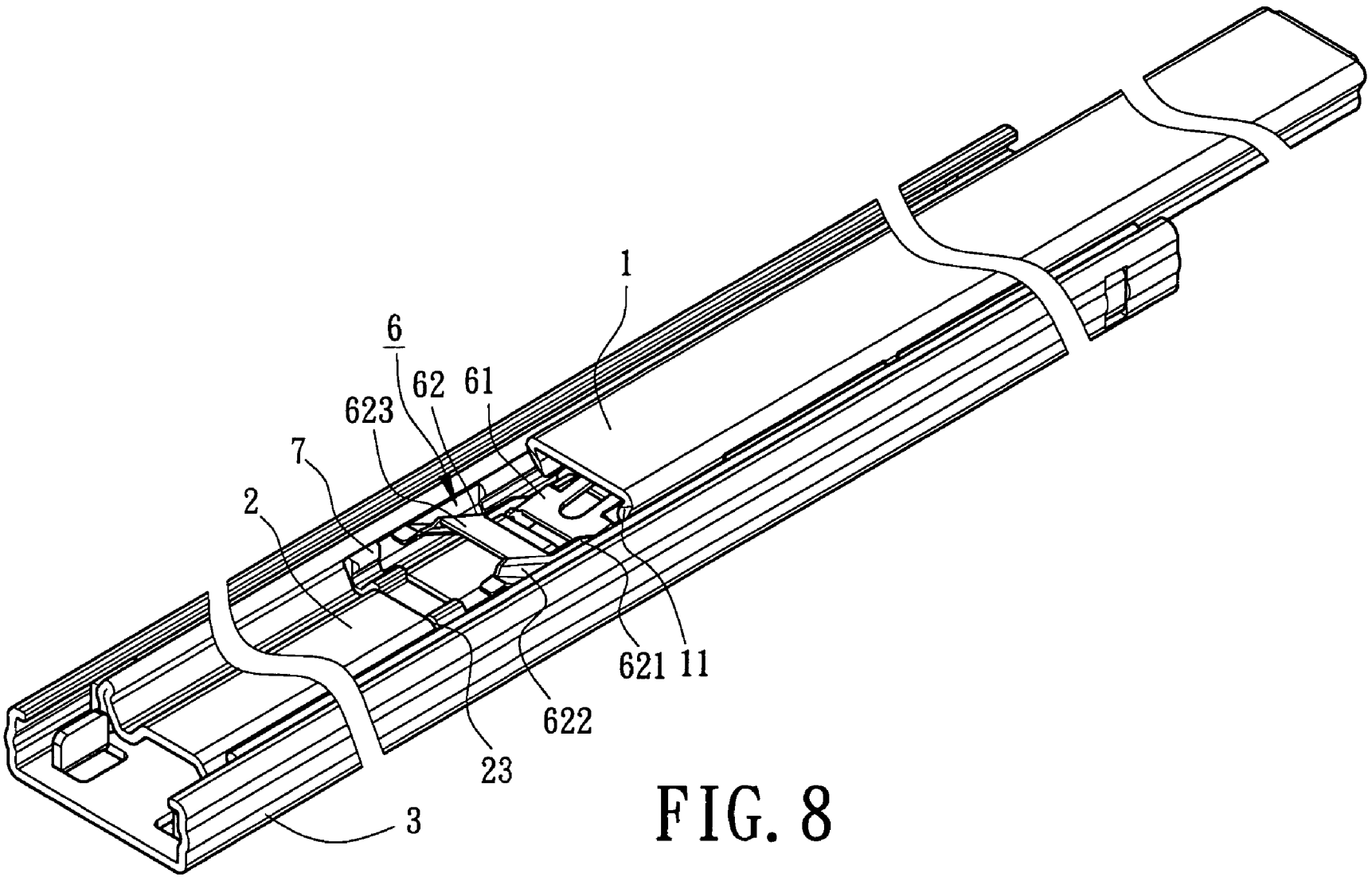
FIG. 8 is an assembled perspective view of the combination of the positioning device with the guiding member for the multi-section slide track assembly of the drawers in accordance with the second embodiment of the present invention.

Turning now to FIGS. 7 and 8, it depicts that a three-section slide track assembly of drawers includes a combination of a positioning device with a guiding member in accordance with the second embodiment of the present invention.

As is known in the first embodiment, the positioning device 6 in accordance with the second embodiment consists of a positioning member 61 and an actuating member 62. In comparison with the first embodiment, the positioning device 6 of the second embodiment further employs a guiding member 7 mounted in the intermediate slide track 2 for guiding the end 11 of the inner slide track 1. In assembling operation, the intermediate slide track 2 has the combination opening 22 in which to receive the guiding member 7 which is sandwiched between the positioning device 6 and the intermediate slide track 2, as best shown in FIG. 8. Preferably, the intermediate slide track 2 provides with a pair of assembling grooves 23 at either end of the assembling opening 22 so that two distal ends of the guiding member 7 is mounted in the corresponding guiding grooves 23. It can be appreciated that the combination opening 22 of the intermediate slide track 2 accommodates the combination of the positioning device 6 with the guiding member 7. In sliding operation, the guiding member 7 can prevent any mis-alignment of the end 11 of the inner slide track 1 with respect to the intermediate slide track 2 that ensures the operation of the slide track assembly.

Figure 9:
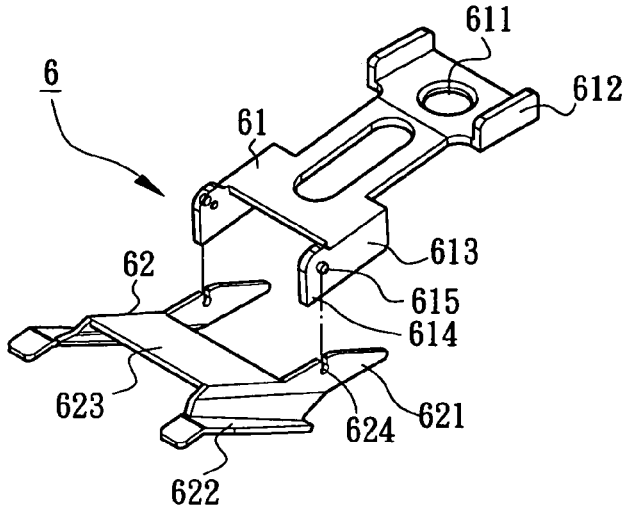
FIG. 9 is a perspective view of a positioning device for a multi-section slide track assembly of drawers in accordance with a third embodiment of the present invention.

Turning now to FIG. 9, it depicts that a three-section slide track assembly of drawers includes a positioning device in accordance with the third embodiment of the present invention.

As is known in the first embodiment, the positioning device 6 in accordance with the third embodiment consists of a positioning member 61 and an actuating member 62. In comparison with the first embodiment, the positioning member 61 and the actuating member 62 of the third embodiment provide with two pivots 615 and two C-shaped recessions 624, respectively. The pivots 615 of the positioning member 61 are freely received in the C-shaped recessions 624 of the actuating member 62.

Figure 10:
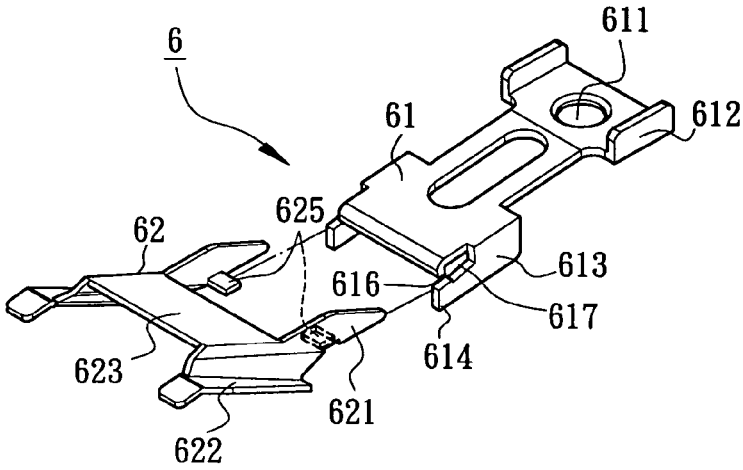
FIG. 10 is a perspective view of a positioning device for a multi-section slide track assembly of drawers in accordance with a fourth embodiment of the present invention.

Turning now to FIG. 10, it depicts that a three-section slide track assembly of drawers includes a positioning device in accordance with the fourth embodiment of the present invention.

As is known in the first embodiment, the positioning device 6 in accordance with the fourth embodiment consists of a positioning member 61 and an actuating member 62. In comparison with the first embodiment, the positioning member 61 of the fourth embodiment provides with a bent extension 616 and a channel 617 thereof. Correspondingly, the actuating member 62 provides with two lugs 625 freely received in the channel 617 of the positioning member 61.

Figure 11:
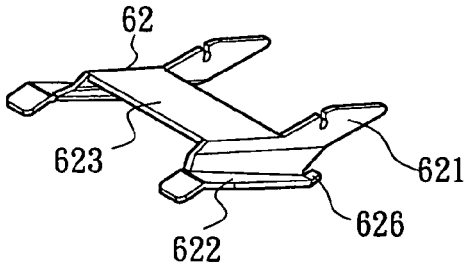
FIG. 11 is a perspective view of an actuating member of a positioning device for a multi-section slide track assembly in accordance with a fifth embodiment of the present invention.
Figure 12:
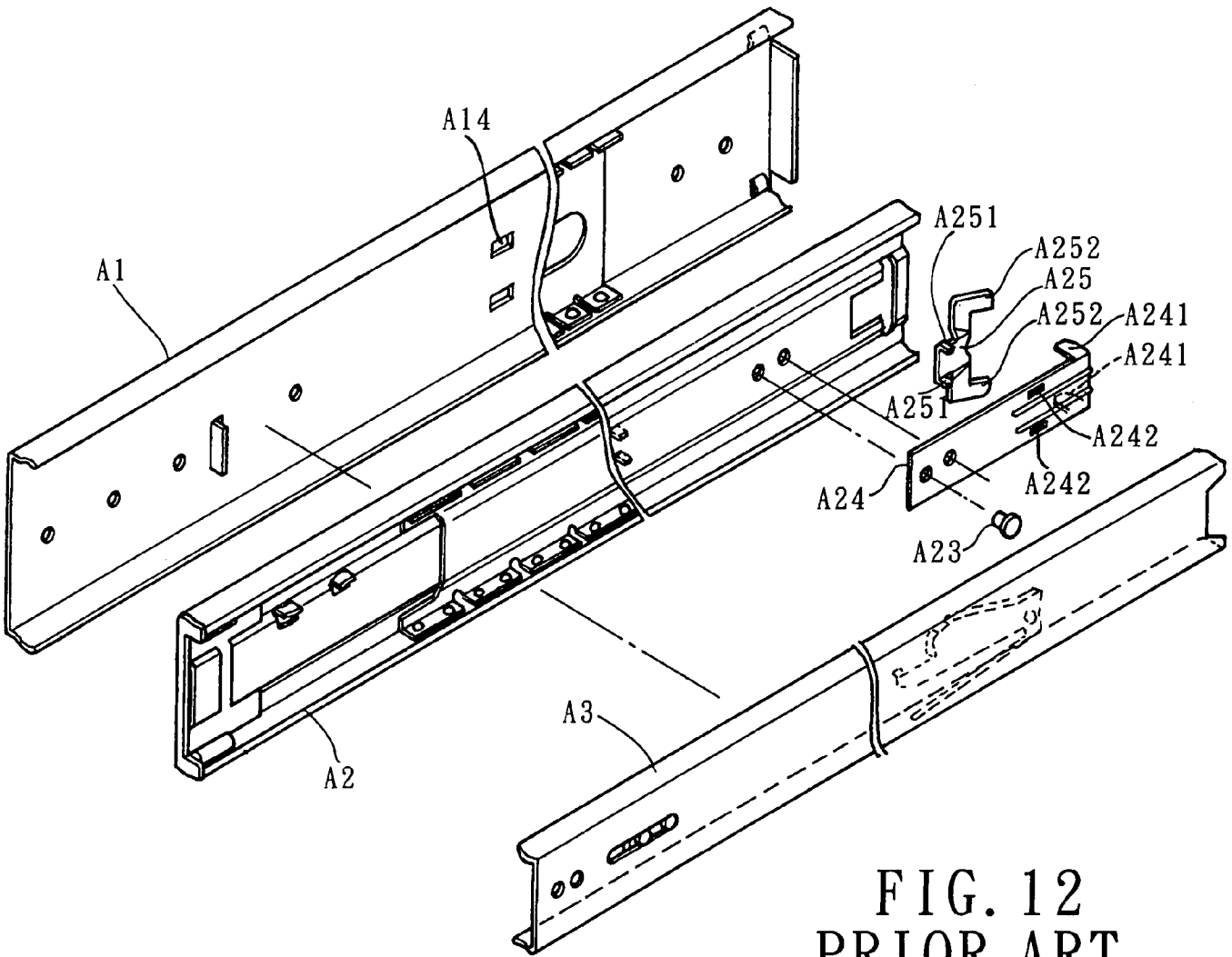
FIG. 12 PRIOR ART
FIG. 12 is an exploded perspective view of a conventional position device for retaining a three-section slide track in accordance with the prior art.

Turning now to FIG. 11, it depicts that a positioning member of a positioning device in accordance with the fifth embodiment of the present invention.

As is known in the first embodiment, the positioning member 61 in accordance with the fifth embodiment includes a pair of arms 621, and a pair of bent guiding edges 622 and a push button 623. In comparison with the first embodiment, the positioning member 61 of the fifth embodiment further includes a pair of bent legs 626. In assembling, the bent legs 626 are in contact with a surface of the intermediate slide track 2 that ensures the pivotal operation of the positioning device 6.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A multi-section slide track assembly, comprising:

an inner slide track;

an intermediate slide track adapted to receive the inner slide track and provided with a combination opening;

a positioning device mounted on the combination opening of the intermediate slide track and consisted of a positioning member and an actuating member pivot-connected each other, the positioning member including at least one engaging end, and the actuating member including a push button for manual operation and at least one bent guiding edge being pressed to actuate the positioning member by a return movement of the inner slide track; and an outer slide track including at least one protrusion for engaging with the engaging end of the positioning member through the combination opening that positions the intermediate slide track on the outer slide track;

wherein the return movement of the inner slide track can actuate the bent guiding edge of the actuating member to disengage the engaging end of the positioning member from the protrusion of the outer slide track that automatically unlocks an engagement of the intermediate slide track with the outer slide track;

wherein a user can manually actuate the push button of the actuating member to disengage the engaging end of the positioning member from the protrusion of the outer slide track that unlocks the engagement of the intermediate slide track with the outer slide track.

2. The multi-section slide track assembly as defined in claim 1, wherein the positioning member and the intermediate slide track provide with an assembling hole and a fixing rod; the fixing rod is press-fit in the assembling hole that mounts the positioning member on the intermediate slide track.

3. The multi-section slide track assembly as defined in claim 1, wherein the positioning member further includes at least one upright bent stop used to confine a relatively sliding movement of a ball rack on the intermediate slide track.

4. The multi-section slide track assembly as defined in claim 1, further comprising a guiding member mounted in the intermediate slide track for guiding the inner slide track.

5. The multi-section slide track assembly as defined in claim 4, wherein the intermediate slide track further includes a pair of assembling grooves proximate either end of the assembling opening, and the assembling grooves accommodate two distal ends of the guiding member when assembled.

6. The multi-section slide track assembly as defined in claim 1, wherein the positioning device further includes at least one pivot member connected between the positioning member and the actuating member.

7. The multi-section slide track assembly as defined in claim 1, wherein the positioning member further includes a pair of pivots.

8. The multi-section slide track assembly as defined in claim 7, wherein the actuating member further includes a pair of C-shaped recessions for receiving the pivots of the positioning members.

9. The multi-section slide track assembly as defined in claim 1, wherein the positioning member provides with a bent extension and a channel thereof; and the actuating member provides with two lugs freely received in the channel of the positioning member.

10. The multi-section slide track assembly as defined in claim 1, wherein the actuating member further includes at least one bent leg in contact with a surface of the intermediate slide track.

11. The multi-section slide track assembly as defined in claim 1, wherein the push button connects a pair of bent guiding edges.

* * * * *